US007559972B2

(12) United States Patent
Liu et al.

(10) Patent No.: US 7,559,972 B2
(45) **Date of Patent: *Jul. 14, 2009**

(54) PROCESS FOR ENHANCED ACID LEACHING OF LATERITE ORES

(75) Inventors: Houyuan Liu, Shortland (AU); Damien Gary Ignatius Krebs, Kengsington (AU)

(73) Assignee: BHP Billiton SSM Technology Pty. Ltd. (AU)

( * ) Notice: Subject to any disclaimer, the term of this patent is extended or adjusted under 35 U.S.C. 154(b) by 0 days.

This patent is subject to a terminal disclaimer.

(21) Appl. No.: 11/838,307

(22) Filed: Aug. 14, 2007

(65) Prior Publication Data

US 2008/0053276 A1 Mar. 6, 2008

Related U.S. Application Data

(63) Continuation of application No. PCT/AU2006/000186, filed on Aug. 17, 2006.

(30) Foreign Application Priority Data

Feb. 14, 2005 (AU) ..... 2005900684

(51) Int. Cl.
*C22B 23/00* (2006.01)

(52) U.S. Cl. ..... 75/743

(58) Field of Classification Search ..... 75/743
See application file for complete search history.

(56) References Cited

U.S. PATENT DOCUMENTS 4,410,498 A * 10/1983 Hatch et al. ..... 423/150.4
4,431,613 A * 2/1984 Verbaan ..... 423/22
4,548,794 A 10/1985 Lowenhaupt et al.
6,261,527 B1 7/2001 Arroyo et al.
6,379,636 B2 4/2002 Arroyo et al.
6,391,089 B1 5/2002 Curlook
7,416,711 B2 * 8/2008 Liu et al. ..... 423/140
2005/0226797 A1 10/2005 Liu et al.

FOREIGN PATENT DOCUMENTS

WO WO 2005/005671 A1 1/2005

* cited by examiner

*Primary Examiner*—Roy King
*Assistant Examiner*—Jie Yang
(74) *Attorney, Agent, or Firm*—Brinks Hofer Gilson & Lione; G. Peter Nichols

(57) ABSTRACT

A process is described for the recovery of nickel and cobalt from a nickeliferous laterite ore including the steps of: providing a nickeliferous laterite ore and separating that ore into its low magnesium limonite fraction and high magnesium saprolite fraction; treating the limonite fraction in acid solution in a primary high pressure leach step to produce a primary leach slurry; adding the saprolite fraction to the primary leach slurry to initiate precipitation of iron as goethite and/or hematite, while simultaneously releasing further acid from the iron precipitation, to effect a secondary atmospheric leach step, producing a secondary leach slurry; wherein all water used to prepare the ore slurries and/or acid solutions has an ionic composition that substantially avoids jarosite formation.

18 Claims, 5 Drawing Sheets

PROCESS FOR ENHANCED ACID LEACHING OF LATERITE ORES

This application is a continuation of and claims priority from PCT/AU2006/000186 published in English on Aug. 17, 2006 as WO 2006/084335 and of AU 2005900684 filed Feb. 14, 2005, the entire contents of each are incorporated herein by reference.

FIELD OF THE INVENTION

The present invention relates to a process for leaching nickeliferous laterite ores by the hydrometallurgical treatment of both the "limonite" and "saprolite" fractions of the ore, in a sequential manner to recover both nickel and cobalt. In particular, the invention relates to a process that combines high pressure acid leaching of the limonite ore fraction of the laterite with atmospheric pressure acid leaching of the saprolite fraction of the ore in a medium that substantially avoids precipitation of iron as jarosite and recovering nickel and cobalt while discarding iron as solid goethite and/or hematite.

BACKGROUND OF THE INVENTION

A laterite ore body is an oxidised ore, and a laterite ore body generally consists of a limonite upper layer (of the ore profile) and a saprolite lower layer. Geological studies have shown that the major nickel containing mineral in the laterite upper layer is the low magnesium content limonite and the major cobalt mineral is asbolane. The major nickel containing minerals in the lower saprolite layer are the high magnesium containing species, serpentine, chlorite, smectite and nontronite. The cobalt content of the saprolite layer is negligible. It must be noted that generally there is no clear demarcation between upper and lower laterite ore layers and on occasions an intermediate layer is often referred to as a transition zone.

In order to establish a sensible, cost effective treatment of a laterite ore body, all mineral types containing nickel and cobalt should be treated in a manner to recover maximum metal values in a simple single process without discarding damaging material to the environment. In this respect, a major consideration with respect to the environmental issues is the nature of the iron compound contained in the discarded ore tailings. A major consideration with respect to cost effective high metal recovery is the quantity and thus cost of the acid used in the leaching process.

Acid leaching of laterite ore solids whether by pressure treatment in an autoclave or by leaching at atmospheric pressure and elevated temperatures results in an acidic discharge which must be neutralised partially before the metal values can be recovered. At the high temperatures used in autoclave digests, typically around 250° C. to 275° C., acid consumption to dissolve metals is doubled or tripled due to the formation of the bisulfate ion ($HSO_4$) and a single proton (H). This is illustrated in the following equations:

$$MeO+2H_2SO_4 \rightarrow Me(HSO_4)_2+H_2O$$

$$Me_2O_3+6H_2SO_4 \rightarrow 2Me(HSO_4)_3+3H_2O$$

The reversion of the bisulfate to the sulfate ion occurs on cooling the slurry releasing an additional proton thus the cooled slurry inevitably contains excess acid which must be neutralised.

U.S. Pat. No. 4,548,794 (Californian Nickel Corporation) describes the use of the saprolite fraction of the ore to neutralise the acidity of the limonite pressure leach material.

However the temperature of the neutralisation was high and the nickel and cobalt recoveries were low.

U.S. Pat. No. 6,379,636 (BHP-Billiton) describes a process which involves pressure acid leaching of limonite followed by atmospheric pressure leaching of saprolite using the autoclave discharge slurry in combination with selected alkali metal ions to form jarosite, $M(Fe_3(SO_4)_2(OH)_6)$, M=Na, K, or $NH_4$, in which form the iron is discharged to the tailings dams.

However iron discharged as jarosite results in high acid consumption as it is known that of the 1.5 moles of sulfuric acid required to dissolve 1 mole of ferric iron, only 1 mole of sulfuric acid is released during jarosite precipitation to aid leaching the saprolite fraction. Jarosite is not a stable compound and slowly releases acid as it weathers, which could have negative environmental impacts.

U.S. Pat. No. 6,391,089 (Curlook) describes a leaching process whereby the acidic autoclave discharge solution was recycled to the ore feed preparation stage thus effecting a significant reduction in acid consumption. However there are complications with the recycling of dissolved magnesium and excess sulfuric acid is needed for magnesium bisulfate $Mg(HSO_4)_2$ formation at the autoclave leach temperature.

Consequently a process which combines the benefits of high metal recovery, per mole of acid consumed, from the complete ore body and the discharge of environmentally acceptable waste solids is most desirable.

The present invention aims to provide a process which overcomes or minimises the difficulties associated with the prior art.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of this application.

SUMMARY OF THE INVENTION

The present invention relates to a process for leaching nickeliferous laterite ores by hydrometallurgical treatment of both the limonitic and saprolitic fractions of the ore in a sequential fashion to recover nickel and cobalt while discarding iron as either goethite, hematite and/or any other form of low sulfate iron oxide or hydroxide.

All water or other media used to form slurries and/or acid solutions that form part of the process in the present invention, have an ionic composition that substantially avoids precipitation of iron as jarosite. That is, the water used in the process should have an ionic composition that is substantially free of sodium, potassium and ammonia ions. It is these ions in particular that are components of jarosite. The absence of such ions will avoid jarosite formation and lead to iron precipitation as goethite and/or hematite. Conveniently, we have referred herein and in the claims to discarding iron as goethite and/or hematite but the iron may be discarded in one or more other forms of low sulfate iron oxide or hydroxide.

Accordingly, the present invention resides in a process for the recovery of nickel and cobalt from a nickeliferous laterite ore including the steps of:

a) providing a nickeliferous laterite ore and separating that ore into its low magnesium limonite fraction and high magnesium saprolite fraction;

b) treating the limonite fraction with acid in a primary high pressure leach step to produce a primary leach slurry;

c) adding the saprolite fraction to the primary leach slurry to initiate precipitation of iron as goethite and/or hematite, while simultaneously releasing further acid from the iron precipitation, to effect a secondary atmospheric leach step, producing a secondary leach slurry;

wherein all water used to prepare the ore slurries and/or acid solutions has an ionic composition that substantially avoids jarosite formation.

Most preferably, both the limonite and saprolite ore fractions processed in the process of the invention are first prepared as a slurry by combining with water before being subjected to the leach process. The solid content of both the limonite and the saprolite fraction slurries is preferably between 20% to 40% w/w. All ore slurries and acid solutions for the leaching steps are prepared with water containing low levels the alkalimetallic ions sodium, potassium, and ammonia. Whereas minor levels of sodium, potassium and ammonia ions may be tolerated, the levels present should be sufficiently low so as to avoid precipitation of iron as jarosite, or at least only insignificant levels of precipitation as jarosite. A component of jarosite is either sodium, potassium or ammonia ions.

The saprolite fraction may be added either directly to the primary leach slurry, or may undergo a preliminary leach step by subjecting the saprolite fraction to an atmospheric pressure leach with sulfuric acid. The resultant preliminary leach slurry is then combined with the primary leach slurry to initiate the secondary atmospheric pressure leach step and the precipitation of iron as goethite and/or hematite. Any transition zone laterite ore material may be processed either with the limonite fraction in the primary pressure leach step, processed together with the saprolite fraction, or may indeed be separately leached and the resultant leach slurry combined with the primary leach slurry.

Most preferably, the process also includes the steps of d) partially neutralising the secondary atmospheric pressure leach slurry to raise the pH to around 1.5 to 2.5 to substantially complete the precipitation of iron as goethite and/or hematite; and e) raising the pH to around 2.5 to 4.5 to precipitate other impurities.

Nickel and cobalt may then be recovered by established techniques from the secondary leach slurry.

DETAILED DESCRIPTION OF THE INVENTION

The leaching process commences with pressure acid leaching of the limonite fraction slurry of a laterite or oxidic ore in a primary pressure leach process to produce a primary leach slurry. Preferably this step is conducted in an autoclave at temperatures of from 230° C. to 270° C. and a pressure of from 40 to 50 Bar. The acid used is preferably concentrated sulfuric acid.

All ore slurries and acid solutions for the leaching steps are prepared with water containing low levels the alkalimetallic ions sodium, potassium, and ammonia. Whereas minor levels of sodium, potassium and ammonia ions may be tolerated, the levels present should be sufficiently low so as to avoid precipitation of iron as jarosite, or at least only insignificant levels of precipitation as jarosite.

The limonite fraction itself, generally contains equal to or greater than 15% iron and equal to or less than 6% magnesium, and has also been referred to herein as a low magnesium content laterite fraction. Major laterite nickel deposits throughout the world have limonite components with iron contents ranging from 15% to 40% iron, and include minerals such as goethite, hematite, nontronite and chlorite.

The primary pressure acid leach step is generally followed by leaching of the saprolite fraction in a secondary atmospheric leach step. The saprolite fraction generally contains equal to or less than 25% iron and equal to or greater than 6% magnesium. It is also referred to herein as a high magnesium content fraction. The saprolite fraction is first formed into a slurry and may be added directly to the primary leach slurry from the primary pressure leach step or it may be subjected to a preliminary atmospheric leach step by the addition of acid to produce a preliminary leach slurry. The preliminary leach slurry is then combined with the primary leach slurry. The oxidation/reduction potential (ORP) is preferably controlled by the addition of sulfur dioxide gas or a sulfite/bisulfite solution such as lithium bisulfite solution which will not cause the formation of jarosite.

The addition of either the saprolite fraction or the preliminary leach slurry to the primary leach slurry initiates precipitation of iron as goethite and/or hematite which simultaneously releases higher levels of acid resulting from the iron precipitation. This initiates the secondary atmospheric leach step and produces a secondary leach slurry. The secondary atmospheric leach step is conducted at an elevated temperature, preferably in the range of about 80° C. to 105° C. Acid discharged from the autoclave of the primary pressure acid leaching of the limonite fraction is also used to assist the secondary atmospheric pressure leaching of the saprolite fraction.

In one embodiment, the saprolite fraction is added directly to the primary leach slurry to initiate precipitation of iron as goethite and/or hematite. Precipitation of the iron simultaneously releases acid which assists in initiating the secondary atmospheric leach process. Additional sulfuric acid may also be added at this stage to supplement the acid produced during iron precipitation.

In a further embodiment, the saprolite fraction may be subjected to a preliminary atmospheric pressure leach prior to adding to the primary leach slurry. The preliminary slurry produced from separately leaching the saprolite fraction can then be combined with the primary leach slurry thereby initiating iron precipitation under atmospheric pressure leach conditions in the secondary leach step.

Once the saprolite fraction is combined with the primary leach slurry, atmospheric leaching of the saprolite fraction will initiate iron precipitation as hematite and/or goethite and is discarded. As only low levels of sodium, potassium and ammonia ions are present in the water used to prepare the ore slurries and acid solutions, the discarded iron will be substantially free of jarosite. Acid released by the precipitation of the iron is combined with the free acid present in the autoclave discharge and additional added acid (if any), to effect leaching of the saprolite fraction and recovery of nickel and cobalt from the total ore body.

The final discarded tailings solids contain iron as goethite and/or hematite and are an acceptable environmental discharge. There are substantially no added alkalimetallic ions or added ammonium species to the system, therefore eliminating the prospect of forming jarosite with the ferric ions present.

The autoclave discharge from the pressure leach contains high free acidity and, in one embodiment is contacted with the saprolite fraction at atmospheric pressure and temperature below the boiling point of the acid, that is the temperature of the autoclave discharge is about 80° C. to 105° C. Additional sulfuric acid may be added. At a pH range of about 1.5 to 2.5, and an acidity of from 0 to 10 g/l $H_2SO_4$, the ferric ions dissolved from the saprolite and the residual ferric ions remaining in the autoclave discharge slurry are precipitated as hematite and/or goethite. The acid released during this precipitation is used in situ to leach more saprolite. The hematite and/or goethite formed is used as a source of fresh concentrated "seed" material to accelerate the hematite and/or goethite precipitation at atmospheric pressure in the temperature range of about 80° C. to 105° C. Rapid precipitation of hematite and/or goethite, reduces vessel size requirements and operating costs.

The resultant secondary leach slurry from the secondary leach step is preferably partially neutralised by the addition of a base, which may typically be chosen from calcium carbonate or hydroxide slurries, or magnesium carbonate or oxide slurries, to raise the pH to around 1.5 to 2.5. At this pH, precipitation of iron as goethite and/or hematite is substantially completed. By raising the pH further, to around 2.5 to 4.5, further impurities such as chromium, copper and aluminium may also be precipitated. The slurries used to raise the pH of the secondary leach slurry are prepared with water having low levels of the alkalimetallic ions, sodium, potassium and ammonia, to avoid jarosite formation.

The total ore may also have a content of transition zone ore, which contains a middle level of magnesium content. Generally, the transition zone, which is found between the limonite and saprolite fractions in the ore body, will have a magnesium content of about 5% to 7%. This middle magnesium content ore may be processed with either the limonite or saprolite fraction, that is it may be subjected to initial pressure leach in the autoclave together with the limonite fraction, or processed with the saprolite fraction by either adding directly to the primary leach slurry or subjected to a preliminary atmospheric pressure leach step with the saprolite fraction. In a further embodiment, the middle magnesium content fraction may also be leached separately under atmospheric conditions with the resultant leach slurry combined with the primary leach slurry in the secondary leach step.

In a most preferred form of the invention, nickel and cobalt are recovered from a laterite or oxidic ore during the process whereby the dissolved iron is precipitated as goethite and/or hematite to achieve a high level of available acid for the leaching process. The secondary leach slurry containing dissolved nickel and cobalt may be subjected to established liquid/solid separation techniques followed by further treatment of the liquid to recover the nickel and cobalt. The solid iron in the form of goethite and/or hematite is discarded.

Discarding iron as goethite and/or hematite, substantially free of jarosite creates environmental benefits, as each is a relatively stable compound thus reducing or eliminating release of acid as it weathers. Further, the level of available acid is produced in situ, reducing the need for added acid providing economic benefit.

In each of the Figures, the whole of ore is first subjected to ore separation to separate the low magnesium content laterite ore (limonite) from the high magnesium content ore (saprolite). This is generally achieved by selective mining or post mining classification. The middle magnesium content ore, which is generally found in the transition zone between the limonite and saprolite fractions, may, as illustrated be processed with either the limonite or saprolite fractions, or be processed separately. In each Figure, this ore is illustrated as "middle Mg laterite".

Also in each of the figures, all slurries and acid solutions used in the leaching processes are prepared using water that contains low levels of alkalimetallic ions.

Figure 1:
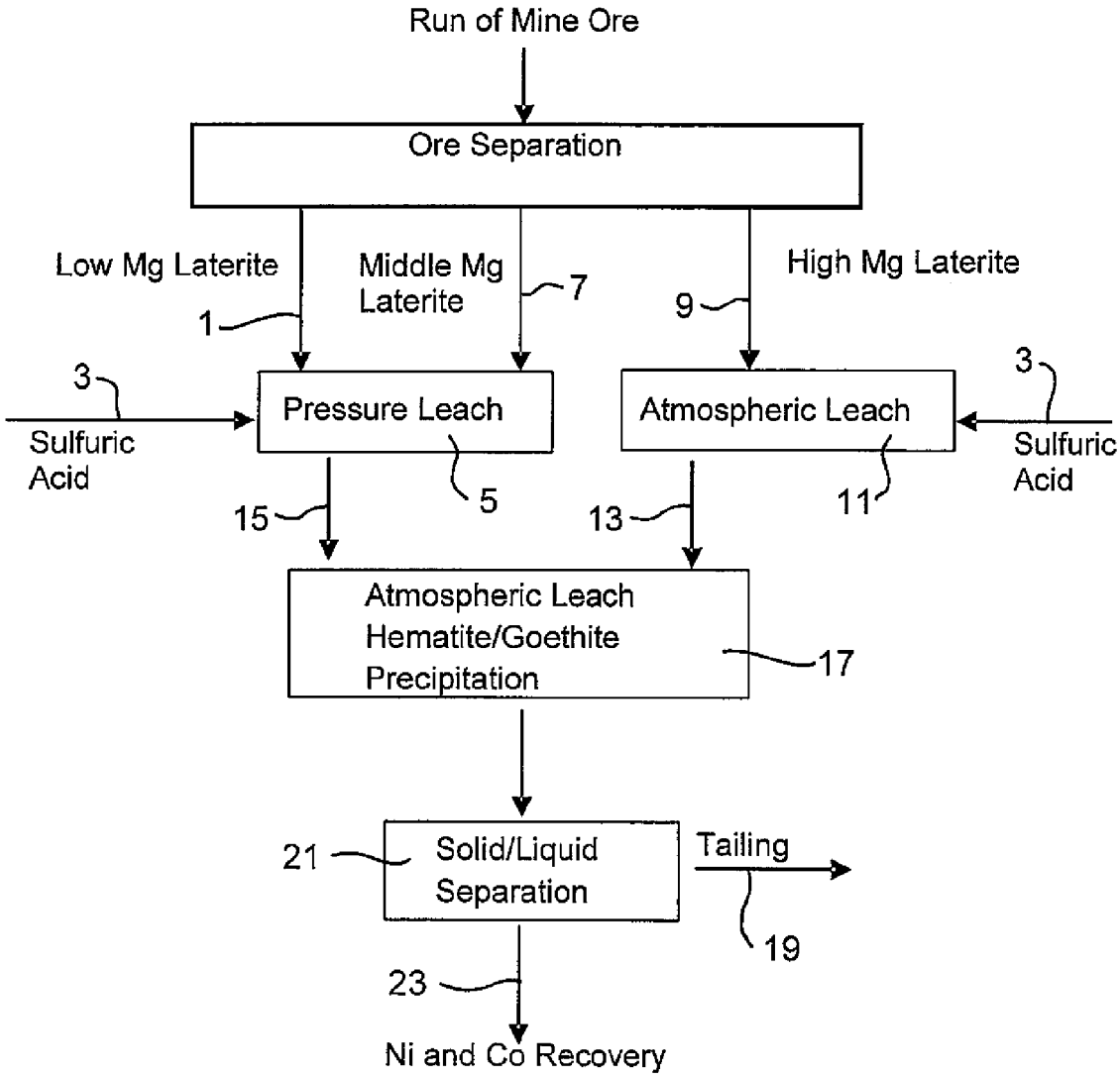
FIGS. 1 to 5 illustrate preferred flowsheets for the process of the invention. It should be understood that the drawings are illustrative of preferred embodiments of the inventions and the scope of the invention should not be considered to be limited thereto.

In FIG. 1, the low Mg laterite fraction (limonite) (1) is treated with sulfuric acid (3) in a pressure leach stage (5) at approximately 250° C. and 45 Bar pressure, together with the middle Mg laterite (7). The high Mg laterite fraction of the ore (9) (saprolite) is treated with sulfuric acid (3) in a preliminary atmospheric pressure leach (11) with temperatures below the boiling point of the acid. Preferably, the temperature of this leach step is about 80° C.-105° C. The quantity of acid to be added is calculated from the predetermined properties of the saprolite, and the desired limonite to saprolite ratio to be processed. This feature of this embodiment allows the ratio of the limonite and saprolite to be processed to be varied, while maintaining high metal recoveries. The high Mg saprolite atmospheric leach slurry (13) is added to the autoclave discharge of the pressure leach stage (15) in a secondary-stage atmospheric pressure leach step (17).

The secondary leach step includes the simultaneous additional leaching of saprolite and precipitation of iron as goethite and/or hematite. With the introduction of the saprolite leach slurry, iron precipitation as goethite and/or hematite will generally occur, releasing more acid to assist with further leaching. The saprolite generally contains some iron as goethite that functions as "seed" material to accelerate the reaction, however to further enhance the reaction "seeds" containing higher concentrations of goethite and/or hematite may be added to assist the precipitation process and enhance leaching.

When the processes of the secondary leaching are deemed complete, classical liquid /solids separation of the slurry may be effected (21) followed by further treatment of the liquor prior to the recovery of nickel and cobalt (23) and the discarding of the goethite and/or hematite solids to waste (19) after adequate pH adjustment.

Figure 2:
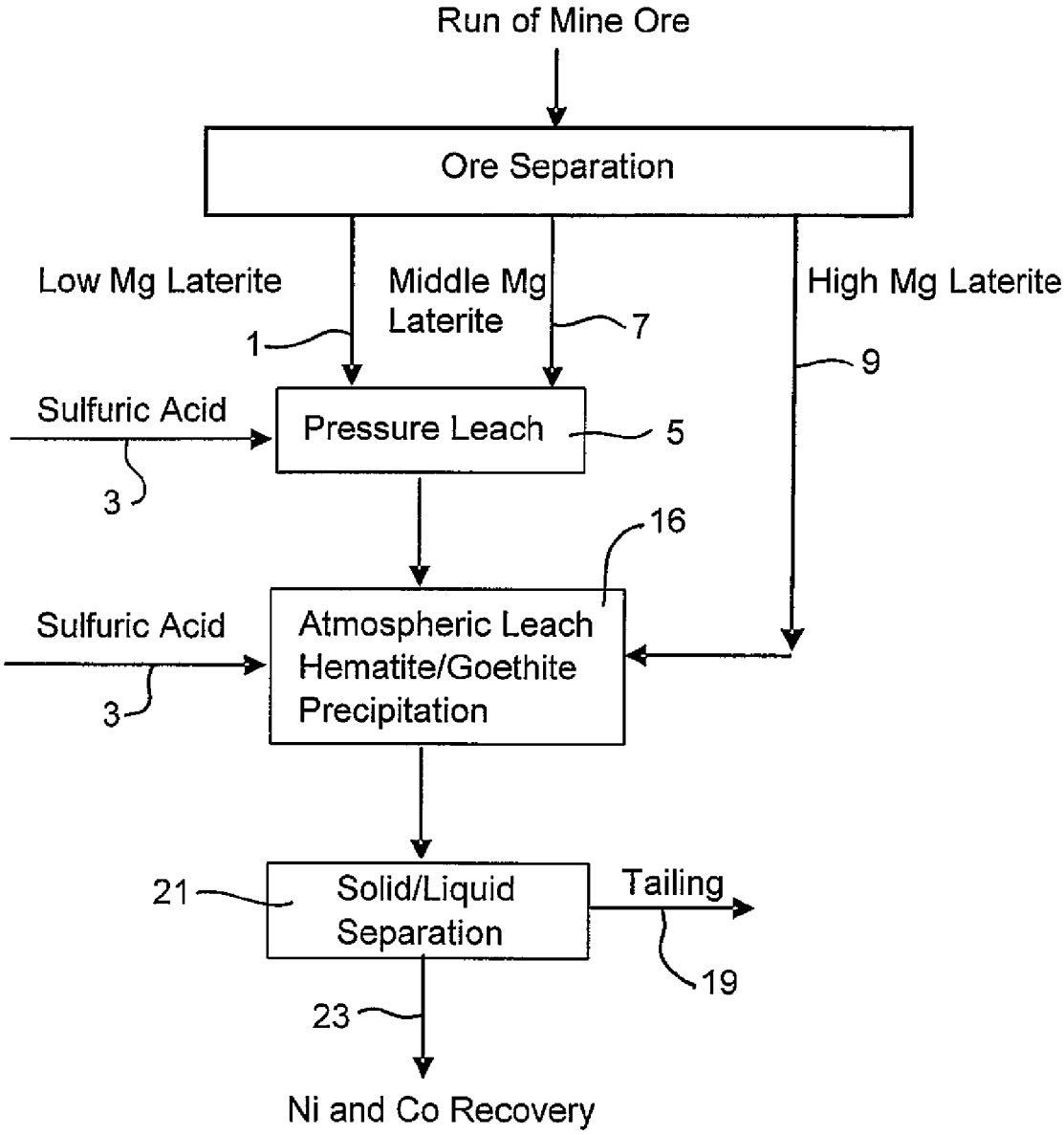

In a second embodiment described in FIG. 2, the low Mg limonite fraction (1) is treated with sulfuric acid (3) in a pressure leach stage (5) together with the middle Mg laterite fraction (7) at approximately 250° C. and 45 Bar pressure. The high Mg fraction of the ore (9) is directly added to the autoclave discharge slurry in an atmospheric leach step (16). Additional sulfuric acid (3) may be added to the second leach stage if required.

The atmospheric leach stage (16) includes the simultaneous leaching of saprolite and precipitation of iron as goethite and/or hematite. The dose of high Mg saprolite ore added to the primary leach slurry is determined by the free acid remaining from the primary pressure leach step, the acid released during the iron precipitation as goethite and/or hematite and the acid consumption of high Mg saprolite fraction at given extractions of Ni, Co, Fe, Mn, Mg and other ions.

When the processes of the atmospheric leaching are deemed complete classical liquid /solids separation of the slurry (21) may be effected followed by further treatment of the liquor prior to the recovery of nickel and cobalt (23) and the discharge of the goethite and/or hematite solids to tailings (19) after adequate pH adjustment.

Figure 3:
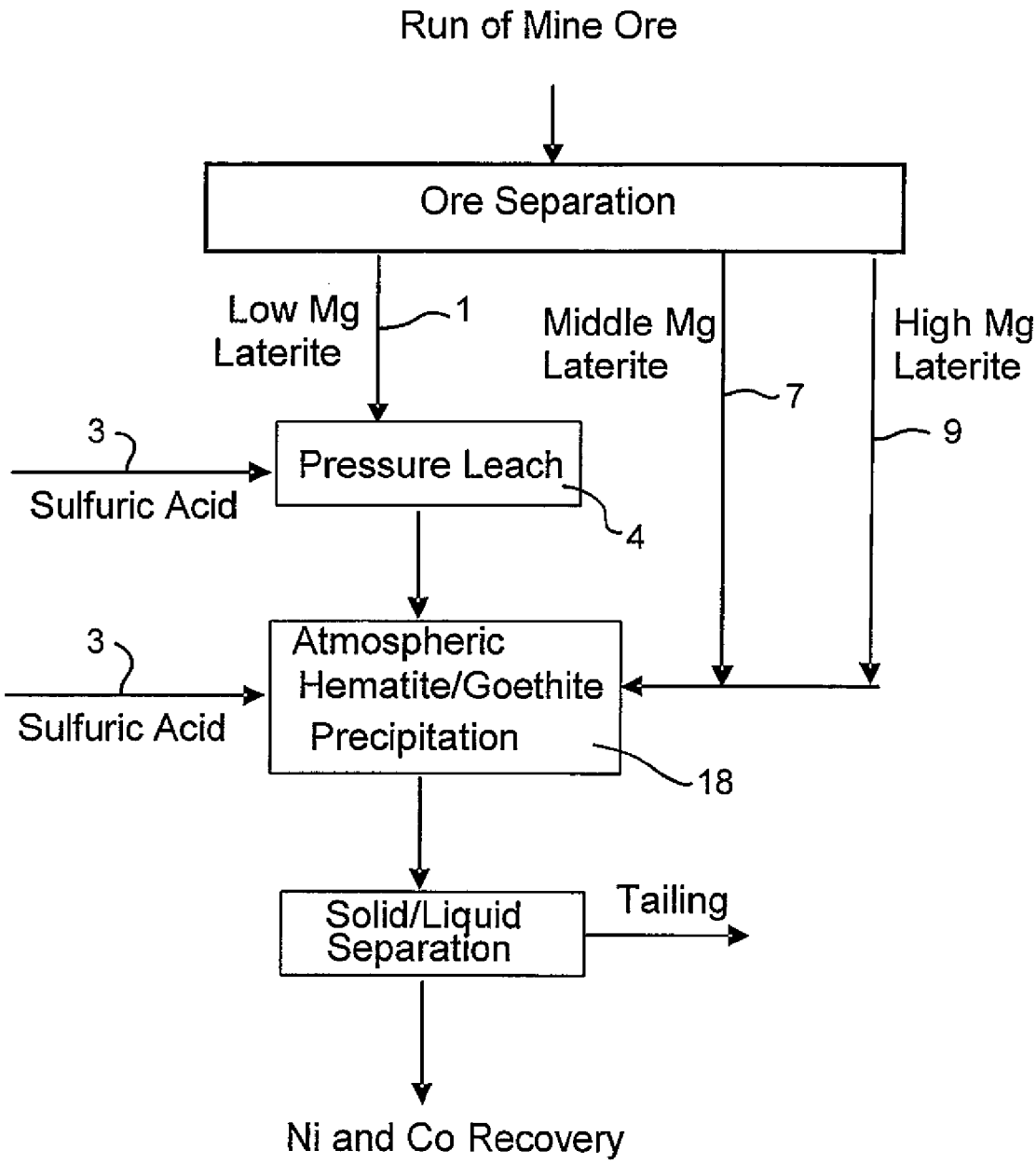

FIG. 3 is a variation of the process described for FIG. 2 in which only the low Mg limonite fraction (1) is subjected to pressure acid leaching (4) while allowing for the middle Mg laterite (7) and high Mg (9) saprolite fractions of the ore to go directly to the secondary leach stage (18). Further sulfuric acid (3) may be added directly to the secondary leach stage.

Figure 4:
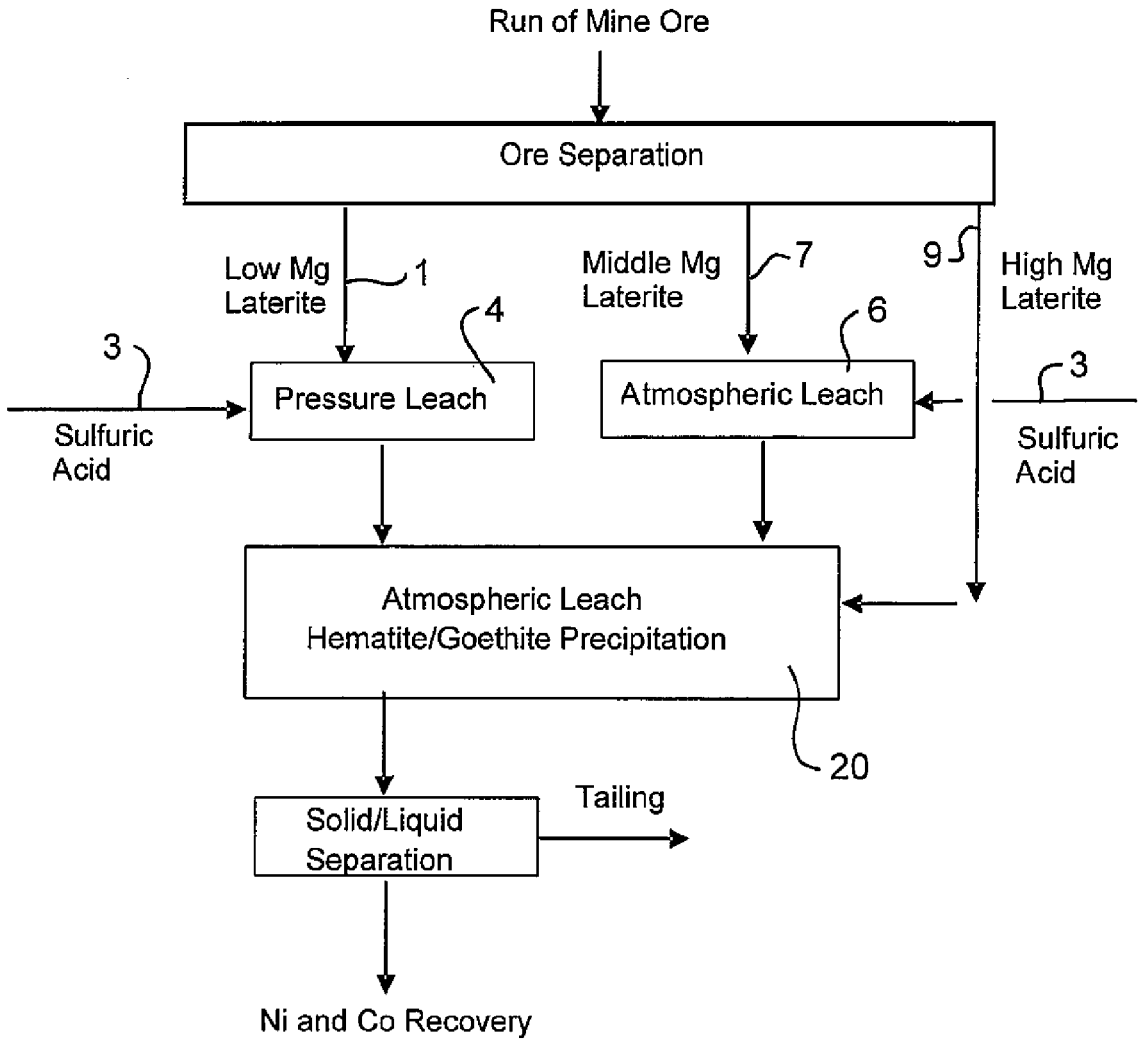

FIG. 4 is a further modification in which the low Mg limonite fraction of the ore (1), is subjected to pressure acid leach leaching (4) while the middle Mg content ore is subjected to a preliminary atmospheric pressure leach (6) with acid (3) at temperatures below the boiling point of the acid (80° C. to 105° C.). The high Mg saprolite fraction (9) is directed to the secondary atmospheric leach process (20) in combination with the high pressure leach slurry and the slurry from the preliminary atmospheric leaching of the middle Mg laterite ore.

Figure 5:
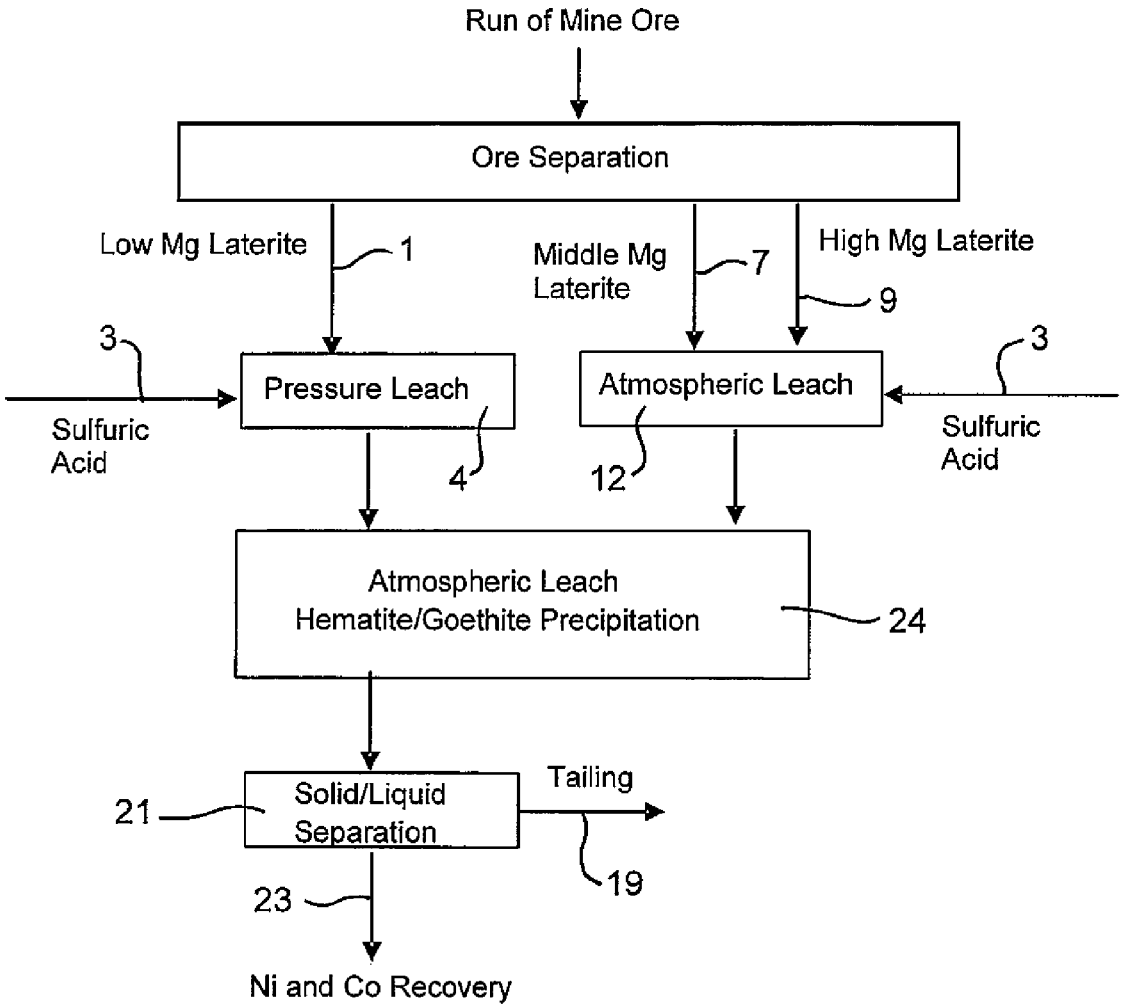

FIG. 5 outlines a process where the low Mg limonite fraction (1) is subjected in an autoclave to a high pressure acid leach (4) following the addition of sulfuric acid (3) while both the middle Mg laterite (7) and high Mg (9) saprolite fractions are treated to preliminary atmospheric pressure leach (12) with sulfuric acid (3) at elevated temperatures. The discharges from the high pressure and atmospheric pressure leaches are combined in a secondary atmospheric leach (24). Nickel and cobalt in solution are recovered by liquid/solid separation of the slurry (21) followed by further treatment of the liquid (23) and removal of iron as goethite and/or hematite in solid form.

EXAMPLES

Example 1

Ore Processing, Chemical Assay and Mineralogy Investigation

Three limonite ore samples were agitated in tap water for two hours and screened at 1 mm. Any oversize material was milled in a rod mill with water which was low in Na, K, and $NH_4$ ions to less than 1 mm. Two saprolite samples were milled in a rod mill with water which was low in Na, K, and $NH_4$ ions to $P_{80}$<75 μm and $P_{100}$<650 μm. The slurries of limonite and saprolite were adjusted to a solids concentration of 30% w/w and 25% w/w respectively. The SG and real PSD (particle size distribution) of the ores were measured with Malvern Instrument is shown in Table 1.

TABLE 1

SG and PSD of Feed Ore

| Feed Ore | SG g/mL | PSD $P_{80}$ μm | PSD $P_{50}$ μm | PSD $P_{10}$ μm |
|---|---|---|---|---|
| Limonite 1 | 3.38 | 19.3 | 7.69 | 2.86 |
| Limonite 2 | 3.52 | 20.7 | 8.63 | 3.14 |
| Limonite 3 | 3.70 | 37.0 | 6.55 | 0.75 |
| Saprolite 1 | 2.77 | 52.0 | 11.9 | 0.76 |
| Saprolite 2 | 3.38 | 46.1 | 17.46 | 3.54 |

The chemical assay results of the ore samples are listed in Table 2.

TABLE 2

Chemical Analysis Laterite Samples

| Sample | Al % | Ca % | Co % | Cr % | Cu % | Fe % | Mg % | Mn % | Na % | Ni % | Pb % | S % | Si % | Zn % |
|---|---|---|---|---|---|---|---|---|---|---|---|---|---|---|
| Limonite 1 | 1.80 | 0.02 | 0.15 | 1.90 | 0.01 | 37.80 | 4.90 | 0.85 | 0.00 | 1.60 | 0.00 | 0.17 | 7.5 | 0.03 |
| Limonite 2 | 2.00 | 0.04 | 0.18 | 2.20 | 0.01 | 41.50 | 2.70 | 0.95 | 0.03 | 1.60 | 0.00 | 0.17 | 5.80 | 0.03 |
| Limonite 3 | 0.91 | 0.31 | 0.08 | 0.31 | 0.01 | 25.20 | 5.20 | 0.35 | 1.80 | 2.30 | 0.00 | 0.17 | 15.30 | 0.00 |
| Saprolite 1 | 1.70 | 0.93 | 0.12 | 0.93 | 0.02 | 13.80 | 14.00 | 0.66 | 0.00 | 1.90 | 0.00 | 0.02 | 17.70 | 0.01 |
| Saprolite 2 | 0.73 | 0.13 | 0.12 | 0.95 | 0.01 | 16.10 | 12.40 | 0.38 | 0.06 | 2.40 | 0.00 | 0.03 | 18.10 | 0.01 |

The results of the ore sample mineralogy investigation are briefly summarised in Table 3.

TABLE 3

Mineralogy

| Ore | Major Ni-containing Mineral |
|---|---|
| Limonite 1 | Goethite |
| Limonite 2 | Goethite |
| Limonite 3 | Goethite |
| Saprolite 1 | Serpentine, garnierite |
| Saprolite 2 | Serpentine, asbolane nontronite |

Example 2

Consecutive Pressure Leach with Limonite 1 Containing 4.9% Mg and Atmospheric Leach with Saprolite 2

914 g of 30.3% w/w Limonite 1 slurry (shown in Example 1) and 118 g 98% $H_2SO_4$ were added to a 2-liter titanium autoclave. The pressure leach in the agitated autoclave lasted one hour (excluding heat up time) at 250° C. and 48 bar. Simultaneously, 1101 g 25.2% w/w Saprolite 2 slurry (shown in Example 1) and 159 g 98% $H_2SO_4$ were combined in a 3-liter agitated glass reactor and leached for 30 minutes at 95°-104° C. and atmospheric pressure. The saprolite was heated to 60° C. prior to the addition of the acid. The final solution acidity of both the pressure leach with limonite and the atmospheric leach with saprolite were 38.3 g/L and 15.7 g/L respectively. The pressure leach slurry was transferred while still hot (~90° C.) into the glass reactor and mixed with saprolite leach slurry to continue the atmospheric leach and iron precipitation at a temperature of 95°-104° C. for a further 9.5 hours. The ORP was controlled in the range of 523-605 mV (versus AgCl probe) by adding lithium bisulfite solution that will not cause the formation of jarosite. The nickel and iron concentration in solution after this atmospheric leach was 4.0 and 3.2 g/L respectively. Limestone slurry (20% w/w, and prepared with water low in Na, K, and $NH_4$ ions) was added to the reactor to reach a pH of 2, maintaining a temperature of 85°-100° C. for one hour, completing iron precipitation. The final nickel and iron concentration in solution after the limestone addition stage was 4.1 g/L and 0.35 g/L respectively.

Table 4 illustrates the key operational conditions and overall extractions of nickel and cobalt. Mineralogical investigation of the final residue using XRD/SEM/EDS indicated the major phase and minor phase of iron precipitation were hematite and goethite respectively. No jarosite was found in final residue.

TABLE 4

Major Operational Conditions and Overall Ni and Co Extractions

| Acid/ limonite (kg/t) | Acid/ saprolite (kg/t) | Limonite/ saprolite Wt Ratio | Acid/ore* (kg/t) | Ni Ext. % | Co Ext. % |
|---|---|---|---|---|---|
| 419 | 562 | 1:1 | 490 | 82.5 | 86.7 |

*limonite plus saprolite

Example 3

Consecutive Pressure Leach with Limonite2 Containing 2.7% Mg and Atmospheric Leach with Saprolite2

914 g of 30.5% w/w Limonite 2 slurry (shown in Example 1) and 104 g 98% $H_2SO_4$ were combined in a 2-liter agitated titanium autoclave. The pressure leach in the autoclave lasted one hour (excluding heat up time) at 250° C. and 48 bar. Simultaneously, 1101 g 25.2% w/w Saprolite 2 slurry (shown in Example 1) and 181 g 98% $H_2SO_4$ were combined in a 3-liter agitated glass reactor and leached for 30 minutes at 95°-104° C. and atmospheric pressure. The saprolite was heated to 60° C. prior to the addition of the acid. The final solution acidity of both the pressure leach with limonite and atmospheric leach with saprolite were 46.1 g/L and 22.6 g/L respectively. The pressure leach slurry was transferred whilst hot (~90° C.) into the glass reactor and mixed with the saprolite leach slurry to continue the atmospheric leach and iron precipitation at a temperature of 95°-104° C. for a further 9.5 hours. The ORP was controlled in the range of 552-621 mV (versus AgCl probe) by adding lithium bisulfite solution that will not cause the formation of jarosite. The nickel and iron concentration in solution after the atmospheric leach was 4.9 and 8.4 g/L respectively. Limestone slurry (20% w/w and prepared with water low in Na, K, and $NH_4$ ions) was added to complete the iron precipitation. The slurry was slowly added into the reactor to a target pH of 2, at 85°-100° C. over a one hour period. The final nickel and iron concentration after the limestone addition stage was 4.3 g/L and 0.48 g/L respectively.

Table 5 illustrates the key operational conditions and overall extractions of nickel and cobalt. Mineralogical investigation of the final residue using XRD/SEM/EDS indicated the major phase and minor phase of iron precipitation were hematite and goethite respectively. No jarosite was found in final residue.

TABLE 5

Major Operational Conditions and Overall Ni and Co Extractions

| Acid/ limonite (kg/t) | Acid/ saprolite (kg/t) | Limonite/ saprolite Wt Ratio | Acid/ore* (kg/t) | Ni Ext. % | Co Ext. % |
|---|---|---|---|---|---|
| 369 | 639 | 1:1 | 505 | 86.7 | 86.4 |

*limonite plus saprolite

Example 4

Consecutive Pressure Leach with Limonite 3 Containing 5.2% Mg and Atmospheric Leach with Saprolite 1

923 g 29.9% w/w Limonite 3 slurry (shown in Example 1) and 114 g 98% $H_2SO_4$ were combined in a 2-liter titanium autoclave. The pressure leach in the autoclave lasted one hour (excluding heat up time) at 250° C. and 48 bar. Simultaneously, 1088 g 24.7% w/w Saprolite 1 slurry (shown in Example 1) and 180 g 98% $H_2SO_4$ were combined in a 3-liter glass reactor and leached for 30 minutes at 95°-104° C. and atmospheric pressure. The saprolite was heated to 60° C. prior to the addition of the acid. The final solution acidity of both the pressure leach with limonite and atmospheric leach with saprolite were 36.3 g/L and 16.7 g/L respectively. The pressure leach slurry was transferred whilst hot (90° C.) into the glass reactor and mixed with the saprolite leach slurry to continue the atmospheric leach and iron precipitation at a temperature 95°-104° C. for a further 9.5 hours. The ORP was controlled in the range of 459-576 mV (versus AgCl probe) by adding lithium bisulfite solution that will not cause the formation of jarosite. The nickel and iron concentrations in solution after the atmospheric leach stage were 4.3 and 1.7 g/L respectively. Limestone slurry (20% w/w and prepared with water low in Na, K, and $NH_4$ ions ) was added to the reactor to a target of pH2, at 85°-100° C. for one hour, to complete the iron precipitation. The final nickel and iron concentration in solution was 4.2 g/L and 0.86 g/L respectively.

Table 6 illustrates the key operational conditions and overall extractions of nickel and cobalt. Mineralogical investigation of the final residue employing XRD/SEM/EDS indicated the major phase and minor phase of iron precipitation were hematite and goethite respectively. No jarosite was found in final residue.

TABLE 6

Major Operational Conditions and Overall Ni and Co Extractions

| Acid/ limonite (kg/t) | Acid/ saprolite (kg/t) | Limonite/ saprolite Wt Ratio | Acid/ore* (kg/t) | Ni Ext. % | Co Ext. % |
|---|---|---|---|---|---|
| 405 | 656 | 1:1 | 533 | 90.6 | 91.0 |

*limonite plus saprolite

The above description is intended to be illustrative of the preferred embodiment of the present invention. It should be understood by those skilled in the art, that various modifications and/or alterations may be made without departing from the spirit of the invention, and still within the scope of the invention.

The invention claimed is:

1. A process for the recovery of nickel and cobalt from a nickeliferous laterite ore including the steps of:

a) providing a low magnesium limonite fraction and high magnesium saprolite fraction of a nickeliferous laterite ore;

b) treating the limonite fraction with acid in a primary high pressure leach step to produce a primary leach slurry;

c) adding the saprolite fraction to the primary leach slurry to initiate precipitation of iron as at least one of goethite or hematite, while simultaneously releasing further acid from the iron precipitation, to effect a secondary atmospheric leach step, producing a secondary leach slurry; wherein all water used to prepare the ore slurries or acid solutions has an ionic composition that contains sufficiently low levels of alkali metallic ions, sodium, potassium, and ammonia, to substantially avoid jarosite formation.

2. A process according to claim 1 wherein the ore fractions are first prepared as a slurry before being subjected to the leach process.

3. A process according to claim 1 including the further steps of:

d) partially neutralising the secondary leach slurry to raise the pH to around 1.5 to 2.5 to substantially complete the precipitation of iron as goethite and/or hematite; and e) raising the pH of the secondary leach slurry to around 2.5 to 4.5 to precipitate other impurities.

4. A process according to claim 3 wherein one of a calcium carbonate or hydroxide slurry, or a magnesium carbonate or oxide slurry is used to raise the pH of the secondary leach slurry.

5. A process according to claim 4 wherein water used to form the slurry used to raise the pH of the secondary leach slurry contains low levels of the alkalimetallic ions, sodium, potassium and ammonia.

6. A process according to claim 5 wherein the low levels of the alkalimetallic ions is sufficiently low such that only insignificant levels of precipitation of jarosite occurs.

7. A process according to claim 1 wherein the limonite fraction contains equal to or greater than 15 wt. % iron and equal to or less than 6 wt. % magnesium.

8. A process according to claim 1 wherein the saprolite fraction contains equal to or less than 25 wt. % iron and equal to or greater than 6 wt. % magnesium.

9. A process according to claim 1 wherein the nickeliferous laterite ore includes a transition zone ore that is processed either a. with the limonite fraction in the primary pressure leach step, b. added together with the saprolite fraction to the secondary leach step, or c. separately leached at atmospheric pressure wherein the resultant slurry is combined with the primary leach slurry in the secondary atmospheric leach step.

10. A process according to claim 1 wherein the limonite fraction is subjected to a pressure acid leach in an autoclave at temperatures of from 230° C. to 270° and a pressure of from 40 to 50 Bar.

11. A process according to claim 1 wherein the saprolite fraction is first subjected to a preliminary atmospheric leach step by the addition of an acid solution to produce a preliminary leach slurry, which is then combined with the primary leach slurry.

12. A process according to claim 1 wherein the secondary atmospheric leach step is conducted within the range of about 80° C.-105° C.

13. A process according to claim 1 wherein additional sulfuric acid is added during the secondary atmospheric leach step to supplement the acid released during iron precipitation.

14. A process according to claim 1 wherein the discharge from the pressure leach contains high free acidity which is contacted with the saprolite fraction leaching slurry at atmospheric pressure and a temperature below the boiling point of the acid.

15. A process according to claim 14 wherein the temperature of the discharge from the pressure leach is in the range of from 80° C.-105° C.

16. A process according to claim 1 wherein the hematite and/or goethite formed is used as a source of fresh concentrated seed material to accelerate the hematite and/or goethite precipitation at atmospheric pressure.

17. A process according to claim 1 wherein acid used in the primary high pressure leach step is concentrated sulfuric acid.

18. A process according to claim 1 wherein the secondary leach slurry contains dissolved nickel and cobalt, wherein the secondary leach slurry is subjected to established liquid/solid separation techniques to recover the nickel and cobalt from the slurry.

* * * * *

UNITED STATES PATENT AND TRADEMARK OFFICE

CERTIFICATE OF CORRECTION

PATENT NO. : 7,559,972 B2
APPLICATION NO. : 11/838307
DATED : July 14, 2009
INVENTOR(S) : Liu et al.

It is certified that error appears in the above-identified patent and that said Letters Patent is hereby corrected as shown below:

On the Title Page

Item (57), line 2, under "ABSTRACT", after "the steps of:" insert --a)--.

Item (57), line 5, under "ABSTRACT", before "treating the limonite" insert --b)--.

Item (57), line 7, under "ABSTRACT", after "leach slurry;" insert --c)--.

Signed and Sealed this

Seventeenth Day of November, 2009

David J. Kappos

David J. Kappos
*Director of the United States Patent and Trademark Office*